US005472376A

United States Patent [19]

Olmstead et al.

[11] Patent Number: 5,472,376

[45] Date of Patent: Dec. 5, 1995

[54] TOOL COMPONENT

[76] Inventors: Bruce R. Olmstead, 130 Ormonde Dr., Mondeor; Moosa M. Adia, 1966 Peacock St., Lenasia South; Klaus Tank, 9 Warbleton Ave., Johannesburg; Kevin P. Ashby, 14 Victoria St., Randburg, all of Transuaal, South Africa

[21] Appl. No.: 172,412

[22] Filed: Dec. 22, 1993

[30] Foreign Application Priority Data

| | | | |
|---|---|---|---|
| Dec. 23, 1992 | [ZA] | South Africa | 92/10000 |
| Jul. 8, 1993 | [ZA] | South Africa | 93/4914 |
| Nov. 2, 1993 | [ZA] | South Africa | 93/8170 |

[51] Int. Cl.[6] ..... B24D 3/04; E21B 10/46

[52] U.S. Cl. ..... 451/540; 51/307; 51/309; 407/118; 407/119; 175/428; 175/432; 175/434

[58] Field of Search ..... 51/307, 309, 204; 407/118, 119; 175/430, 431, 432, 433, 434, 426, 427, 428

[56] References Cited

U.S. PATENT DOCUMENTS

| | | | |
|---|---|---|---|
| 4,109,737 | 8/1978 | Bovenkerk | 175/430 |
| 4,714,385 | 12/1987 | Komanduri | 417/118 |
| 4,784,023 | 11/1988 | Dennis | 175/434 |
| 4,861,350 | 8/1989 | Phaal et al. | 51/204 |
| 4,959,929 | 10/1990 | Burand et al. | 407/119 |
| 4,972,637 | 11/1990 | Dyer | 407/118 |
| 4,997,049 | 3/1991 | Tank et al. | 407/118 |
| 5,007,207 | 4/1991 | Phaal | 51/204 |

*Primary Examiner*—Robert A. Rose

*Attorney, Agent, or Firm*—Scully, Scott, Murphy & Presser

[57] ABSTRACT

A tool component comprises an abrasive compact layer bonded to a cemented carbide substrate along an interface. The abrasive compact layer has a working surface, on a side opposite to the interface. This working surface is flat and presents a cutting edge or point around its periphery. A recess extends into the substrate from the interface. The recess has a side wall and a base both of which are located entirely within the carbide substrate. The recess has a portion located in the interface. The area of this portion is at least 25 percent the area of the interface. A material, different to that of the substrate, fills the recess and is bonded to the substrate. This material will typically be abrasive compact of the same type as the abrasive compact layer, or a cemented carbide which has characteristics different to that of the substrate.

9 Claims, 2 Drawing Sheets

TOOL COMPONENT

BACKGROUND OF THE INVENTION

This invention relates to tool components comprising a composite abrasive compact.

Composite abrasive compacts consist of an abrasive compact layer bonded to a substrate which is generally a cemented carbide substrate. The abrasive compact layer comprises a mass of abrasive particles, typically diamond or cubic boron nitride, bonded into a hard conglomerate. Such layers are polycrystalline in nature and contain a high abrasive particle content. Diamond compacts are also known as polycrystalline diamond or PCD. Cubic boron nitride compacts are also known as polycrystalline cubic boron nitride or PCBN.

Composite abrasive compacts are manufactured under elevated temperature and pressure conditions, e.g. diamond or cubic boron nitride synthesis conditions.

Composite abrasive compacts are used in a variety of cutting, drilling, milling and other such operations. It is an edge or point formed on the abrasive compact layer of such composite compacts which performs the cutting, drilling, milling or other such operation.

Composite diamond abrasive compacts are used extensively in drilling. While they generally perform admirably in drilling, the diamond compact layer does tend to spall or break under some of the stressful conditions which can be encountered during drilling.

U.S. Pat. No. 4,861,350 describes a tool component in the form of a composite abrasive compact wherein the abrasive compact has two zones which are joined by an interlocking, common boundary. The one zone provides the cutting edge or point for the tool component, while the other zone is bonded to a cemented carbide substrate. In one embodiment, the cemented carbide substrate has a central portion extending into the abrasive compact defining a peripheral abrasive compact stepped region surrounding the central portion.

SUMMARY OF THE INVENTION

According to the present invention, a tool component comprises an abrasive compact layer bonded to a cemented carbide substrate along an interface;

the abrasive compact layer having a working surface, on a side opposite to the interface, which is flat and which presents a cutting edge or point on its periphery;

a recess extending into the substrate from the interface, the recess having a side wall and a base located entirely within the carbide substrate and a portion in the interface which has an area at least 25 percent of the area of the interface; and a material completely filling the recess and being bonded to the substrate, the material being different to that of the substrate.

DESCRIPTION OF EMBODIMENTS

Figure 1:
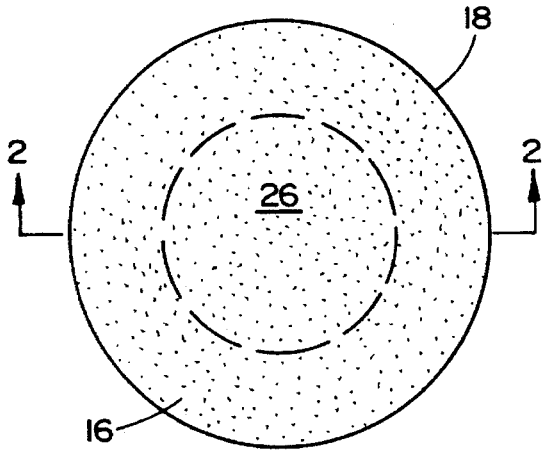
FIGS. 1 and 2 are plan and sectional side views, respectively, of an embodiment of the invention.

The material-filled recess and its location in the cemented carbide substrate has the effect of introducing a compressive pre-stress in the abrasive compact layer thereby strengthening that layer and reducing the incidence of spalling and breakage during use.

The material-filled recess has a side wall and a base which are both located entirely within the carbide substrate. This means that the entire side wall and the base will be provided and defined by the carbide substrate. The side wall may have one or more discontinuities in it, e.g. can be of square, rectangular or polygonal shape or it can be circular. The recess also has a portion which is located in the interface. The area of that portion is at least 25 percent of the area of the interface. Generally, the area of the portion of the recess in the interface will be less than 95 percent of the area of the interface. Preferably, the area of the portion of the recess in the interface will be 40 to 75 percent of the area of the interface.

The recess may extend a substantial depth into the substrate. The depth will depend on various factors such as the nature of the material which fills the recess and the shape and configuration of the recess.

The recess is entirely surrounded by carbide and will typically be centrally located in the substrate. This will generally mean that the portion of the recess which is located in the interface will also be centrally located therein.

The recess preferably has a right-circular cylindrical shape. With such a shape, it is preferred that the base has one or more concentric steps, each successive step extending deeper into the substrate from the interface as the steps progress towards the centre of the base.

The base of the recess may have one or more discontinuities which, when provided, are preferably provided by surfaces which define an angle therebetween.

It is important that the recess be filled with material that is different from the substrate and such as to produce in the compact layer, on manufacture, a compressive pre-stress which strengthens that layer. To achieve this, the material will typically be stiffer than the carbide of the substrate, and may also have greater thermal shrinkage and/or thermal expansion properties than the carbide of the substrate.

In one preferred form of the invention, the material is abrasive compact which is the same as the abrasive compact layer. This preferred aspect of the invention has particular application to tool components wherein the abrasive compact layer is a diamond abrasive compact layer.

The material filling the recess may also be a cemented carbide having diamond particles dispersed therein, or a cemented carbide having different characteristics to that of the substrate, e.g. a coarser grain size and/or a high metal binder content.

The cemented carbide for the substrate may be any known in the art such as cemented titanium carbide, cemented tungsten carbide, cemented tantalum carbide, cemented molybdenum carbide, or mixtures thereof. As is known, such cemented carbides will typically have a metal binder content of 3 to 30 percent by mass. The metal binder will typically be cobalt, iron or nickel or an alloy containing one or more of these metals.

The abrasive compact has a working surface on a side opposite to the interface between the compact layer and the cemented carbide substrate. This surface is flat and presents a cutting edge or point in its periphery. Typically, this layer will be circular in plan and the circular periphery will provide a cutting edge.

The tool components of the invention have particular application in rotary drill bits used for drilling earth formations.

Figure 2:
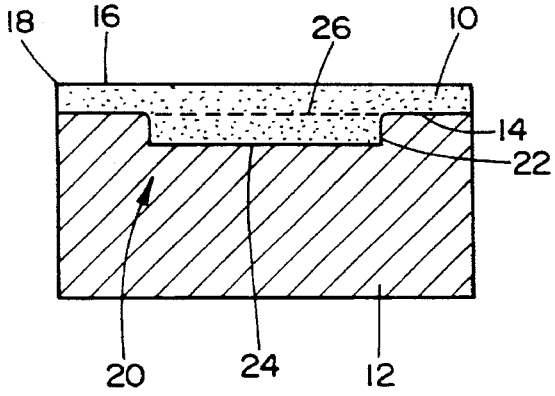

Embodiments of the invention will now be described with reference to the accompanying drawings. Referring first to FIGS. 1 and 2, a tool component comprises an abrasive compact layer 10 bonded to a cemented carbide substrate 12 along an interface 14. The abrasive compact layer 10 has an upper flat working surface 16 having a circular periphery 18 which provides a cutting edge for the component.

A recess 20 extends from the interface 14 into the cemented carbide substrate 12. The recess is disc-shaped and has side walls 22 and a base 24. It will be noted that the recess is surrounded by carbide and is located entirely within the carbide substrate.

The recess 20 is filled with the same abrasive compact as that of the layer 10.

The compact-filled recess 20 has a portion, shown by the dotted lines 26 in FIG. 2, which is located in the interface 14. This portion 26 has an area at least 25 percent the area of the interface 14.

Figure 3:
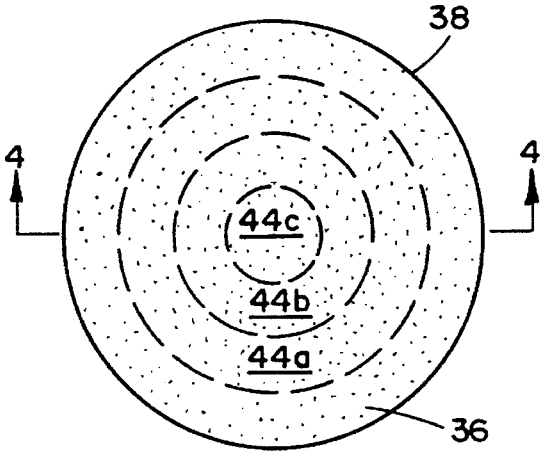
FIGS. 3 and 4 are plan and sectional side views, respectively, of a second embodiment of the invention.
Figure 4:
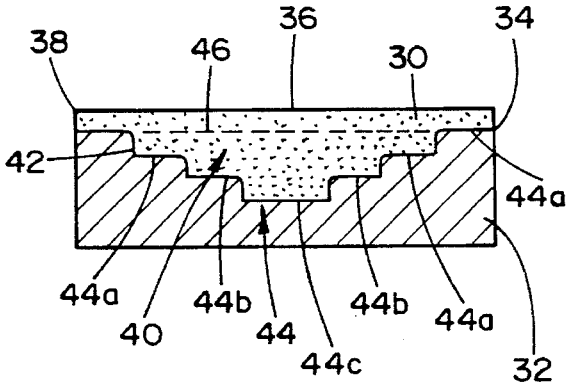

A second embodiment of the invention is illustrated by FIGS. 3 and 4. Referring to these figures, a tool component comprises an abrasive compact layer 30 bonded to a cemented carbide substrate 32 along an interface 34. The abrasive compact layer 30 has an upper working surface 36 which is flat and which has a circular periphery 38. It is this circular periphery 38 which provides a cutting edge for the component.

A recess 40 extends into the substrate 32 from the interface 34. The recess 40 is disc-shaped having side walls 42 and a stepped base 44. The stepped base has two steps 44*a* and 44*b*. The steps extend deeper into the substrate 32 as they progress towards the centre of the base. Thus, step 44*b* is lower than step 44*a*. The lowermost surface of the base is shown by 44*c*.

The recess 40 is filled with the same abrasive compact as that of layer 30.

The recess has a portion, indicated by the dotted lines 46 in FIG. 4, located in the interface 34. This portion has an area at least 25 percent the area of the interface.

Figure 5:
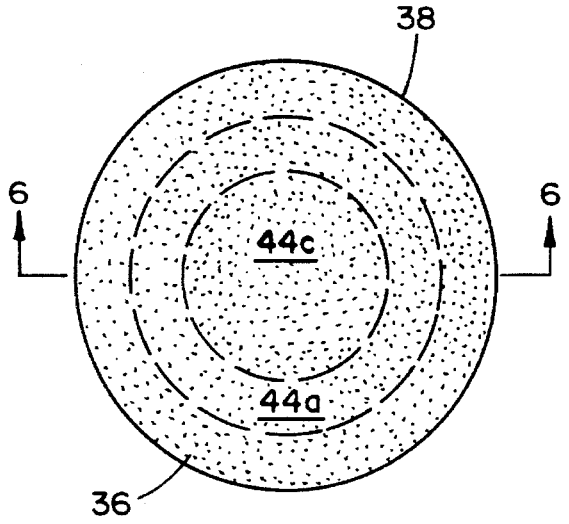
FIGS. 5 and 6 are plan and sectional side views, respectively, of a third embodiment of the invention.
Figure 6:
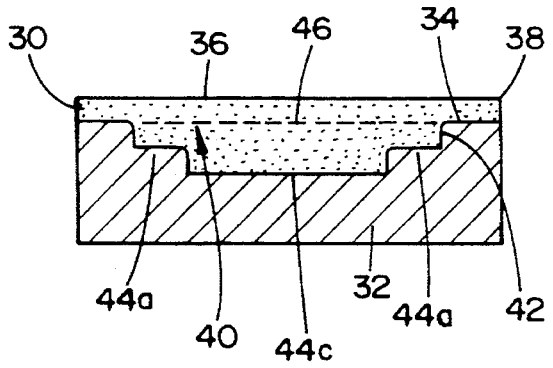

The embodiment of FIGS. 5 and 6 is similar to that of FIGS. 3 and 4 and like parts carry like numerals. This embodiment differs from that of FIGS. 3 and 4 in that only one step 44*a* is provided. The lowermost part of the base 44 is again indicated by 44*c*.

Figure 7:
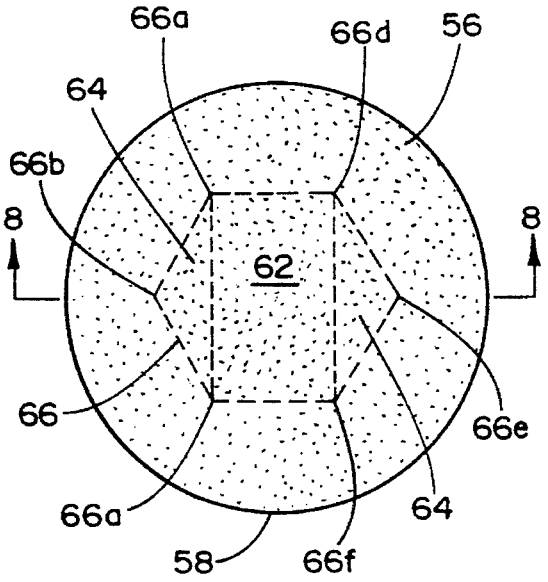
FIGS. 7 and 8 are plan and sectional side views, respectively, of a fourth embodiment of the invention.
Figure 8:
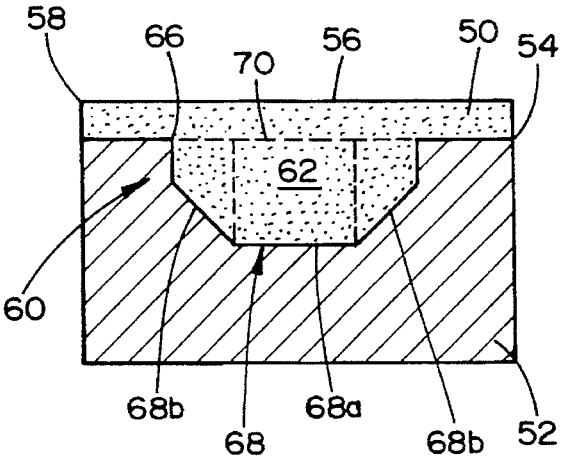

A fourth embodiment of the invention is illustrated by FIGS. 7 and 8. Referring to these figures, a tool component comprises an abrasive compact layer 50 bonded to a cemented carbide substrate 52 along an interface 54. The abrasive compact layer 50 has an upper working surface 56 which is flat and which has a circular periphery 58. It is this circular periphery 58 which provides a cutting edge for the component.

A recess 60 extends into the substrate 52 from the interface 54. The recess 60 has a central portion 62 and side portions 64. This results in a peripheral side wall 66 of hexagonal shape which has several discontinuities in it, as can be seen at 66*a* to 66*f* in FIG. 7. The base 68 of the recess is provided by a flat lower section 68*a* and sloping side sections 68*b*.

The recess 60 is filled with the same abrasive compact layer as that of the layer 50.

The recess 60 has a portion, indicated by dotted lines 70 in FIG. 8, located in the interface 54. This portion has an area at least 25 percent the area of the interface.

The tool components illustrated above may be made by methods generally known in the art. For example, a cemented carbide substrate or green form thereof, may have an appropriately shaped recess formed in one surface thereof and the components necessary to produce an abrasive compact placed on the surface of the substrate which has the recess formed therein. This unbonded assembly is then subjected to the elevated temperature and pressure conditions required to produce an abrasive compact of the components. These conditions and the apparatus used for carrying out such a method are well known in the art.

We claim:

1. A tool component comprising, an abrasive compact layer bonded to a cemented carbide substrate along an interface;

the abrasive compact layer having a working surface, on a side opposite to the interface, which is flat and which presents a cutting edge or point on its periphery;

a recess extending into the substrate from the interface, the recess having a side wall and a base, both of which are located entirely within the carbide substrate, and the base of the recess having one or more discontinuities, with the flat surface of the abrasive compact being disposed above a top of the side wall of the recess, with the discontinuities being disposed below the top of the side wall of the recess, and a portion in the interface having an area at least 25 percent of the area of the interface; and an abrasive compact material, the same material as in the abrasive compact layer, completely filling the recess and being bonded to the substrate, the material being different from that of the substrate.

2. A tool component according to claim 1, wherein the area of the portion of the recess in the interface is less than 95 percent of the area of the interface.

3. A tool component according to claim 1, wherein the area of the portion of the recess in the interface is 40 to 75 percent of the area of the interface.

4. A tool component according to claim 1, wherein the recess is centrally located in the substrate.

5. A tool component according to claim 1, wherein the recess is right-circular cylindrical in shape.

6. A tool component according to claim 1, wherein each discontinuity is provided by surfaces which define an angle therebetween.

7. A tool component according to claim 1, wherein the recess is right-circular cylindrical in shape and the base has one or more concentric steps, with each successive step extending deeper into the substrate from the interface as the steps progress towards the center of the base.

8. A tool component according to claim 1, wherein the side wall of the recess has one or more discontinuities.

9. A tool component according to claim 1, wherein the abrasive compact is a diamond abrasive compact.

* * * * *